US007788873B2

(12) United States Patent
Leek

(10) Patent No.: US 7,788,873 B2
(45) Date of Patent: Sep. 7, 2010

(54) GABLE END BRACE

(75) Inventor: William F. Leek, Carmel, CA (US)

(73) Assignee: Simpson Strong-Tie Co., Inc., Pleasanton, CA (US)

( * ) Notice: Subject to any disclaimer, the term of this patent is extended or adjusted under 35 U.S.C. 154(b) by 1667 days.

(21) Appl. No.: 10/281,724

(22) Filed: Oct. 26, 2002

(65) Prior Publication Data

US 2004/0079034 A1 Apr. 29, 2004

(51) Int. Cl.
*E04B 1/38* (2006.01)

(52) U.S. Cl. ..... 52/702; 52/712

(58) Field of Classification Search ..... None
See application file for complete search history.

(56) References Cited

U.S. PATENT DOCUMENTS

| | | | | |
|---|---|---|---|---|
| 1,945,925 | A | | 2/1934 | Stiefel |
| 2,321,221 | A | * | 6/1943 | Linehan |
| 2,413,362 | A | | 12/1946 | Maxwell et al. |
| 3,256,030 | A | * | 6/1966 | Banse |
| 3,967,908 | A | | 7/1976 | Snow et al. |
| 4,198,175 | A | | 4/1980 | Knepp et al. |
| 4,410,294 | A | | 10/1983 | Gilb et al. |
| 4,480,941 | A | | 11/1984 | Gilb et al. |
| 4,572,695 | A | | 2/1986 | Gilb |
| 4,714,372 | A | | 12/1987 | Commins |
| 4,932,173 | A | | 6/1990 | Commins |
| 4,976,085 | A | | 12/1990 | Krueger |
| 5,109,646 | A | | 5/1992 | Colonias et al. |
| 5,603,580 | A | | 2/1997 | Leek et al. |
| 5,653,079 | A | * | 8/1997 | Loeffler et al. ..... 52/712 |
| 5,836,131 | A | * | 11/1998 | Viola et al. ..... 52/702 |
| H1795 | H | * | 7/1999 | Leek ..... 52/712 |
| 5,979,130 | A | | 11/1999 | Gregg et al. |
| 6,176,057 | B1 | | 1/2001 | Bouchet et al. |
| 6,230,467 | B1 | * | 5/2001 | Leek ..... 52/702 |
| 6,260,402 | B1 | | 7/2001 | Leek |
| 6,295,780 | B1 | * | 10/2001 | Thompson ..... 52/712 |
| 6,295,781 | B1 | * | 10/2001 | Thompson ..... 52/712 |
| 6,446,409 | B1 | | 9/2002 | Emerson |
| 6,513,290 | B2 | | 2/2003 | Leek |

OTHER PUBLICATIONS

Harold John Andrews, title: Bracket for Timber Joints, U.K. Patent Application No. GB 2 026 644 A, filed: Jul. 26, 1978, (total of 4 pages).

(Continued)

*Primary Examiner*—Richard E Chilcot, Jr.
(74) *Attorney, Agent, or Firm*—James R. Cypher; Charles R. Cypher

(57) ABSTRACT

A connector and method of using the connector for making a structural connection between two structural members joined at an angle. The connector is bent in the field to allow the connector to be used in both left-hand and right-hand connections. The connector is preferably formed from metal with an integral gusset at the longitudinal line of juncture. The connector is preferably attached to the structural members by a plurality of fasteners. The gusset reinforces the connection against forces acting perpendicular to the longitudinal line of juncture and the plurality of fasteners reinforce the connection against angular displacement of the structural members perpendicular to the longitudinal line of juncture.

17 Claims, 11 Drawing Sheets

OTHER PUBLICATIONS

Tim Caves, Declaration of Tim Caves, Simpson Strong-Tie A34 and A35 framing angles, total of 3 pages, (declaration signed Oct. 15, 2003, attached drawings: as early as May 1, 2000).

Arthur Maher, "Engineered Nailing Simplifies Framing," pp. 137-140, (Aug. 1964).

BMF Bygningsbeslag A/S, "Handvaerkerkatalog,"( total of 2 pages), (1989).

BMF-Simpson, "Bausysteme fur Holz," Statische Werte, (front and back page, pp. 5, 22-26, 30, 31, 39, 57, 58), (2002).

Hughes Manufacturing, Inc., "Product Catalog 1996/1997," Zambetti Steel Products, Inc. (Jancksonville, Florida), (front and back page, p. 17 and 35), (1996).

Lumberlok Engineered Metal Fasteners, "Truss-To-Truss Connections," Division of Gang-Nail Canada Inc. (Canada), (p. 23), (as early as Nov. 20, 1990).

Simpson Strong-Tie Company, Inc., "Catalog C-2002," Top Flange Hangers, Simpson Strong-Tie Company, Inc. (United States of America), (pp. 43, 55, and 139), (2002).

United Steel Products Company, "SBCCI Public Safety Testing and Evaluation Services, Inc.," Report No. 2031A, Category: Hangers and Supports, SBCCI PST & ESI (United States of America), (pp. 1-23), (2001).

United Steel Products Company, "USP Lumber Connectors," USP Full Line Catalog, Unites Steel Product Company (United States of America),(front and back page, pp. 64 and 132), (1998).

United Steel Products Company, "USP Structural Connectors," Truss & Rafter, United Steel Products Company (United States of America),(pp. 56 and 57), (2003).

* cited by examiner

GABLE END BRACE

BACKGROUND OF THE INVENTION

This invention relates to a connector for joining two structural members. The connector of the present invention has particular utility with respect to light frame building construction. The connector of the present invention can be used alone or in pairs to make an angled connection between two framing members.

Many different connectors are used for joining two structural members at right angles to each other.

The most basic of these connectors is called an angle, and generally consists of a piece of sheet steel having a single right angle bend along its length to create two flanges lying at right angles to each other. The connector is normally provided with openings for receiving fasteners that are driven through the connector and into the side faces of the structural members to be connected.

Apart from the most basic connector described above, a variety of connectors have been developed for very specific uses. Such connectors include: joist hangers, column caps, gable end braces, stud plate ties, roof truss clips, truss bearing enhancers, and seismic ties.

The present invention provides an improved connector for making a angled connection between two structural members and has particular utility for anchoring a gable brace to an exterior wall.

SUMMARY OF THE INVENTION

The present invention teaches a connector and a method for using that connector to make a connection between two structural members set at an angle to each other.

The connector resists vertical or horizontal loads, depending on the orientation of the structural members, as well as resists angular displacement.

The present invention also provides a connector for making an angled connection between two structural members that can be used as a single member or in pairs for added strength.

The present invention provides for a connector that can be attached on both the left and right sides of a first structural member.

It is an object of the present invention provide a pair of connectors that can anchor a gable brace to an exterior wall of a building on which rests a gable end truss.

It is a further object of the present invention to connect a gable end truss to a top plate of a wall and a gable brace to the top plate of a wall, without attaching the gable brace to the gable end truss, and without having the gable end truss rest on the connector or connectors of the present invention, or attach to the connector or connectors of the present invention.

Another object of the present invention is to provide a connector that may be easily bent in the field by the installer to create left and right-handed connectors.

Another object of the present invention is to provide a connector that can be used in pairs on the left and right sides of a structural member to be braced, and can be used on structural members of varying widths, since the pair of connectors is too separate members.

A further object of the present invention is to provide a connector that may be easily bent in the field by the installer to adapt the connector to a variety of installation types.

The preferred embodiment of the connector of the present invention is provided with a gusset.

An object of the present invention is to provide a corner connection that resists angular displacement of the structural members perpendicular to the longitudinal line of juncture of the connector.

A further object of the present invention is to provide a corner connection wherein the connector resists bending at the longitudinal line of juncture.

A further object of the present invention is to provide a corner connection wherein the connector is easily and inexpensively manufactured and installed.

DESCRIPTION OF THE PREFERRED EMBODIMENTS OF THE PRESENT INVENTION

Figure 5:
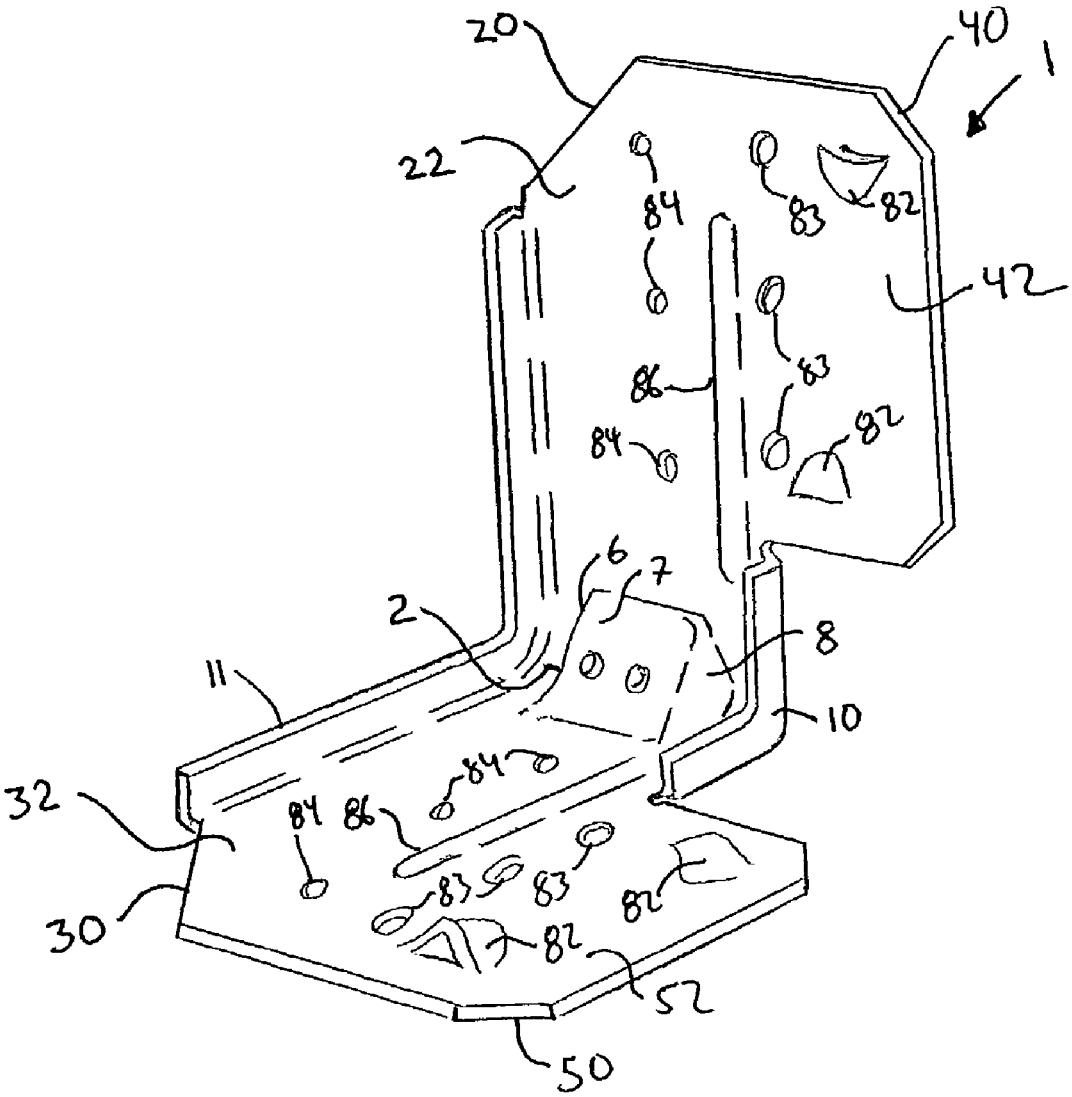
FIG. 5 is a perspective view of a connector formed according to the present invention.

As shown in FIG. 5, the preferred connector 1 of the present invention is formed with a longitudinal line of juncture 2.

In the preferred embodiment, the longitudinal line of juncture 2 divides the connector 1 into a first member 20, with an outer surface 21 and an inner surface 22, and a second member 30, with an outer surface 31 and an inner surface 32.

In the preferred embodiment, the first and second members 20 and 30 are joined together at an angle to each other at the juncture line 2.

The outer surfaces 21 and 31 of the first and second members 20 and 30 can interface with at least a portion of the planar surface of a structural member, and the outer surfaces 21 and 31 of the first and second members 20 and 30 lie at a selected angle to each other. In the preferred embodiment, this angle is 270 degrees, or 90 degrees depending on the angle between the faces to be measured.

Figure 1:
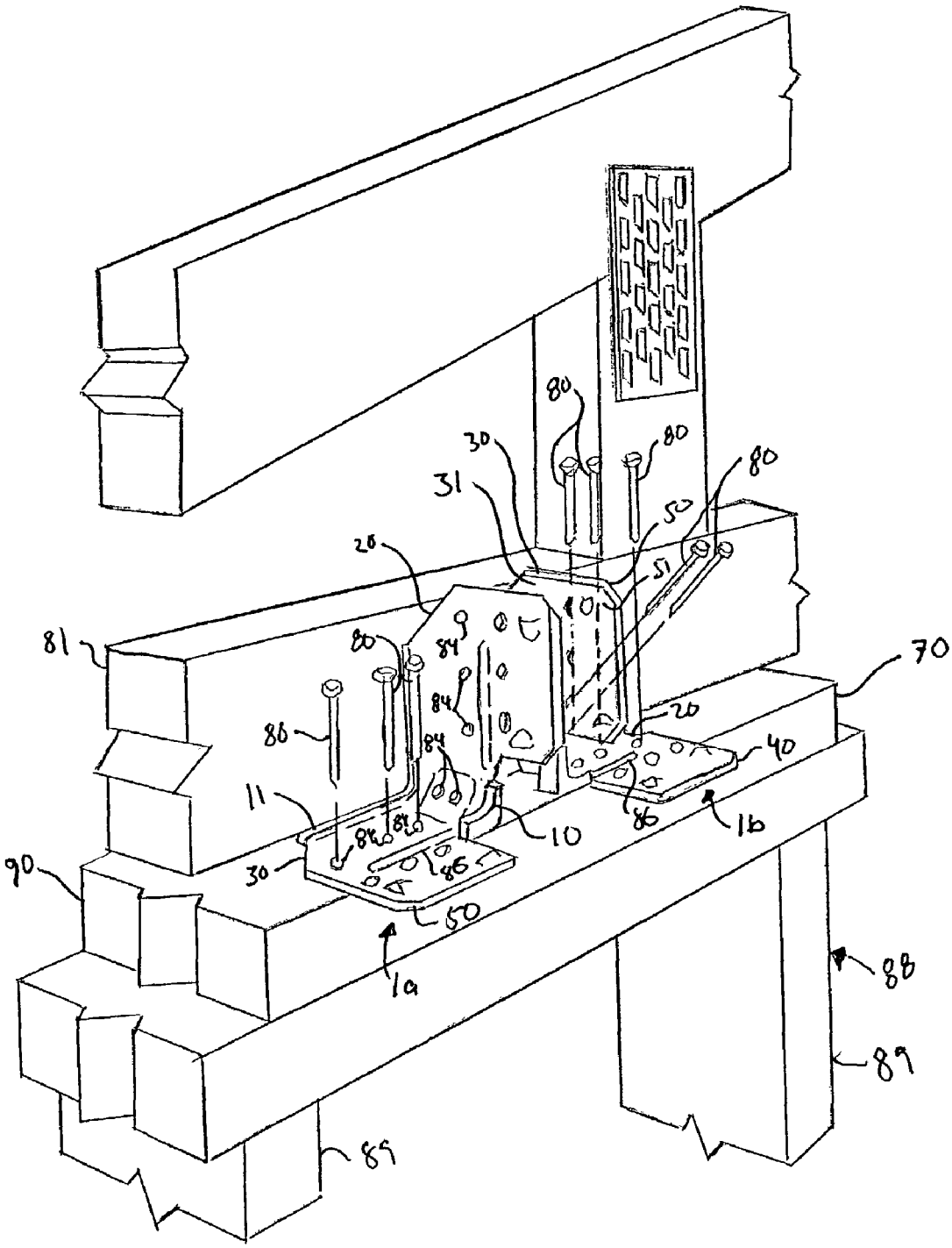
FIG. 1 is a perspective view of a pair of connectors formed according to the present invention, being attached by fasteners to the top plate of a wall. A gable end truss rests on top of the top plate of the wall.
Figure 3:
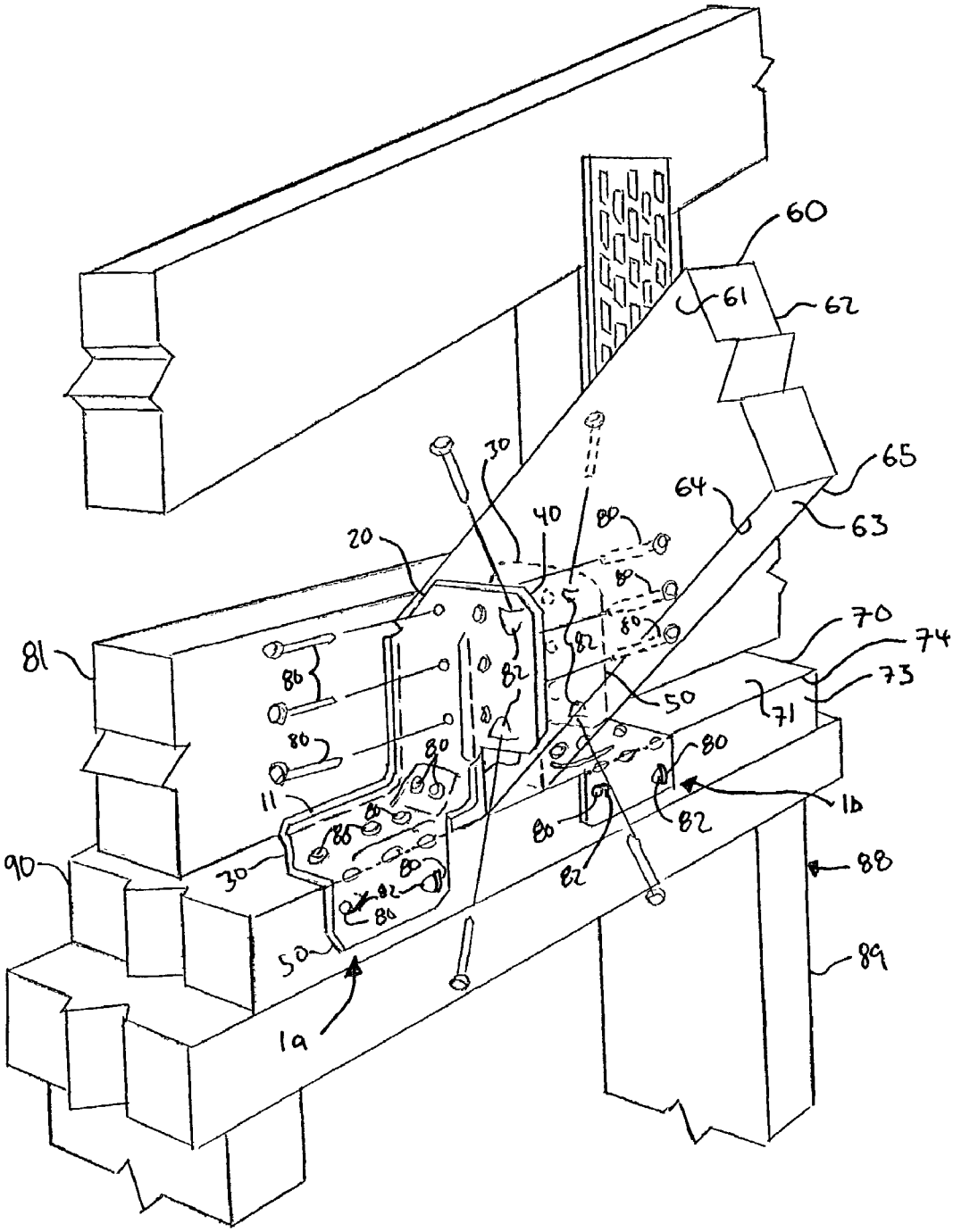
FIG. 3 is a perspective view of the same pair of connectors. A gable brace is shown received between the pair of connectors and resting against the gable end truss and on top of the top plate. Additional fasteners are shown, entering into the gable brace.

As is shown in FIGS. 1 and 3, in the preferred embodiment, when the connector 1 is used, the outer surface 21 of the first member 20 is held in registration with the inner surface 61 of a first structural member 60 by a plurality of fasteners 80, and the outer surface 31 of the second member 30 is held in close registration with the inner surface 71 of a second structural member 70 by a plurality of fasteners 80.

As shown in FIG. 5, the preferred connector 1 is also formed with first and second extension members 40 and 50. In the preferred embodiment of the invention, the first and second extension members 40 and 50 are formed as extensions of the first and second members 20 and 30 respectively. The first extension member 40 is attached to first member 20. The second extension member 50 is attached to the second member 30.

Like the first member 20, the first extension member 40 is formed with an outer surface 41 and an inner surface 42. In the preferred embodiment, when the connector 1 is initially produced and given to the installer, the outer surface 41 of the first extension member 40 is coplanar with the outer surface 21 of the first member 20.

The second extension member 50 is formed with an outer surface 51 and an inner surface 52. In the preferred embodiment, when the connector 1 is initially formed, the outer surface 51 of the first extension member 50 is coplanar with the outer surface 31 of the first member 30.

Initially forming the connector with the outer surfaces 21 and 41 of the first member 20 and first extension member 40, and the outer surfaces 31 and 51 of the second member 30 and the second extension member 50 as substantially coplanar members allows three objects to be accomplished.

First, because of the coplanar relationship between the outer surfaces 21 and 41 and between outer surfaces 31 and 51, and despite the presence of the first and second extensions 40 and 50, the connector 1 can be used as a simple angle connector between two structural members. Thus, when the connector is used as a simple angle connector, the outer surface 21 of the first member 20 and the outer surface 41 of the first extension member 40 would be held in registration with the inner surface of the first structural member by a plurality of fasteners, and the outer surface 31 of the second member 30 and the outer surface 51 of the second extension member would be held in close registration with the inner surface of the second structural member by a plurality of fasteners.

Second, in the preferred embodiment, one of the extension members 40 and 50 can be bent such that the outer surface 21 of the first member 20 could lie at an angle to the outer surface 41 of the first extension member or the outer surface 31 of the second member 30 could lie at an angle to the outer surface 51 of the second extension member 50. As shown in FIGS. 1 through 4 this angle can be a right angle, although other angles are also contemplated by the inventors. As shown in FIGS. 1 through 4, when anchoring a gable brace to an exterior wall, it is desirable to use a pair of connectors and to bend over only one of the extension members on each connector. By allowing the installer to bend the extension members in the field according to her needs, left and right-handed embodiments of the connector do not have to be produced by the factory. The same connector can be adapted to either serve as a left-side connector 1*a* or as a right-side connector 1*b* in the gable brace connection shown.

Figure 11:
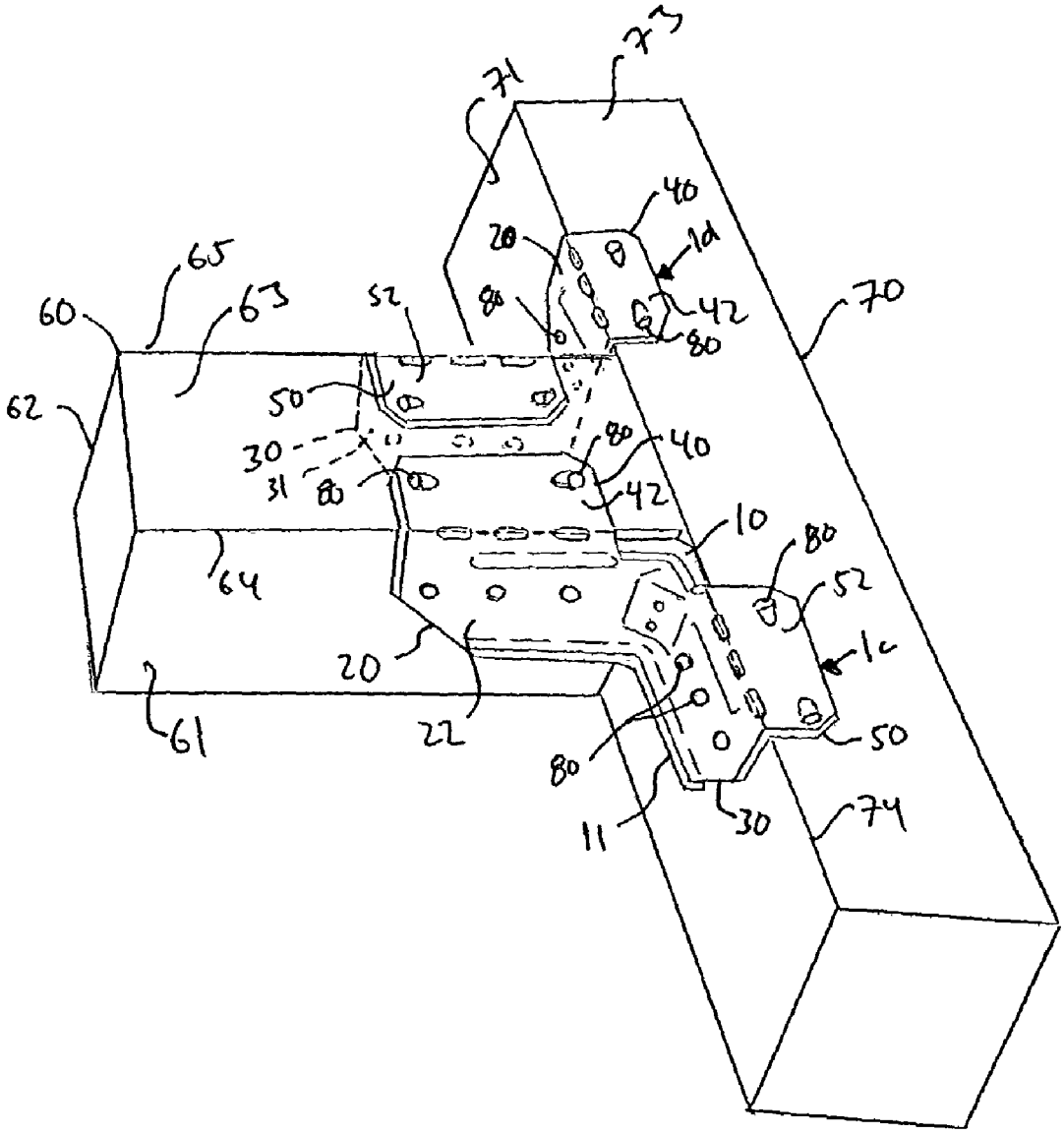
FIG. 11 is a perspective view of a pair of connectors formed according to the present invention connecting a joist to a header.
Figure 12:
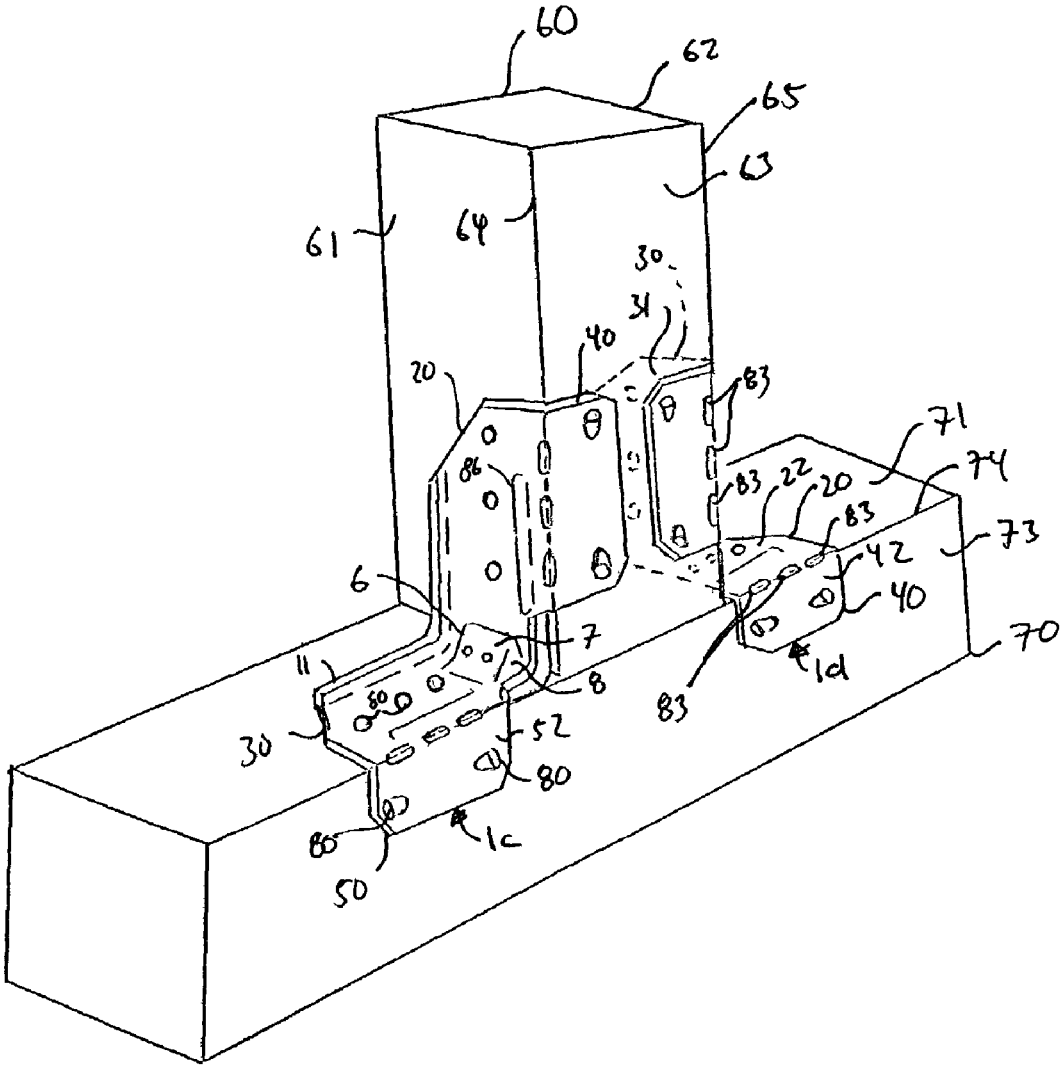
FIG. 12 is a perspective view of a pair of connectors formed according to the present invention connecting a first structural member, in this case a post, to a second structural member, in this case a sill.

Third, both of the extension members 40 and 50 can be bent to create a second type of left-and-right side connectors 1*c* and 1*d* as shown in FIGS. 11 and 12. FIG. 11 shows a joist to header connection, and FIG. 12 shows a post-to-mudsill connection in which the first structural member 60, in this case a post 60, is vertically oriented and the second structural member 70, in this case a mudsill 70, is horizontally disposed. In both figures, both the first and second extension members 40 and 50 have been bent at right angles to the first and second members 20 and 30. The first extension 40 of the left connector 1*c* has been bent and connected to the lateral surface 63 of the first structural member 60 with the outer surface 41 of the first extension interfacing with the lateral surface 63, and the second extension 50 of the right connector 1*d* has been bent and connected to the lateral surface 63 of the first structural member 60, with the outer surface 51 of the second) extension interfacing with the lateral surface 63. Fasteners 80 hold the first and second extensions 40 and 50 to the lateral surface 63 of the first structural member 60.

The formation of the connection described in the second example will now be described in more detail to better explain how left-handed and right-handed connectors 1*a* and 1*b* can be made from the same starting connector 1.

The following description relates to the connection of a first structural member 60 with a second structural member 70.

The first structural member 60 has a pair of inner parallel surfaces 61 and 62 that are substantially planar and lie parallel to each other and a lateral surface 63 that is substantially planar and joins with the inner surfaces 61 and 62 along separate edges 64 and 65.

The second structural member 70 has an inner surface 71 that is substantially planar and a lateral surface 73 that is substantially planar and joins with said inner surface along an edge 74.

As shown in FIGS. 1 through 4, the first structural member 60 is a 2×4 gable brace. A double angle cut has been formed in the gable brace so that it will sit flat on the inner surface 71 of the wall double plate—the second structural member 70—and flush against a gable end truss 81, also sitting on the inner surface 71 or top surface of the second structural member 70, in this case a wall double plate 70.

As shown in FIGS. 1 through 4, the top plate 70 of the wall is an elongated member, and the gable end truss 81 runs along the length of the top plate along the exterior side of the second structural member 70, in this case a top plate 70. The gable end truss 81 is connected to the top plate 70 by fasteners which are not shown. The gable brace is disposed at an angle to the gable end truss; as shown in FIGS. 1 through 4, this angle is preferably a right angle. The first structural member 60, in this case a gable brace 60, approaches the top plate 70 at an angle, and approaches from the interior side of the top plate 70 of the wall.

In the preferred embodiment, the second extension 50 of the first connector 1*a* and the first extension member 40 of the second connector 1*b* attach to the lateral surface of the second structural member 70, in this case a top plate 70, which is the interior side of the top plate 70 of the exterior wall 88. The exterior wall is made up in part of vertically) disposed studs 89 on which the doubled top plate 70 rests.

In the preferred embodiment, no portions of the first and second connectors 1*a* and 1*b* are disposed underneath the gable end truss 81 or on the exterior side 90 of the second structural member 70 in this case a top plate 70.

In the preferred embodiment, the first structural member 60, in this case a gable brace 60, is not connected to the gable end truss 81, although it abuts a vertical face of the gable end truss. Also, the gable end truss 81 does not rest on the first and second connectors 1*a* and 1*b*, nor does the gable end truss attach to the first and second connectors 1*a* and 1*b*. The fact that the gable end truss 81 does not rest or attach to the first and second connectors 1*a* and 1*b* allows the gable brace connection to be made after the gable end truss 81 has been attached to the second structural member 70, in this case a top plate 70.

The connectors 1*a* and 1*b* brace the first structural member 60, in this case a gable brace 60, and are stiff enough to resist twisting of the gable brace 60.

As is shown in FIG. 1, the first of the pair of connectors 1*a* is attached to the second structural member 70 by means of fasteners 80 such that the outer surface 31 of the second member 30 interfaces with the inner surface 71 of the second structural member 70 and the fasteners, shown as nails 80, connect the second member 30 to the second structural member 70.

Figure 2:
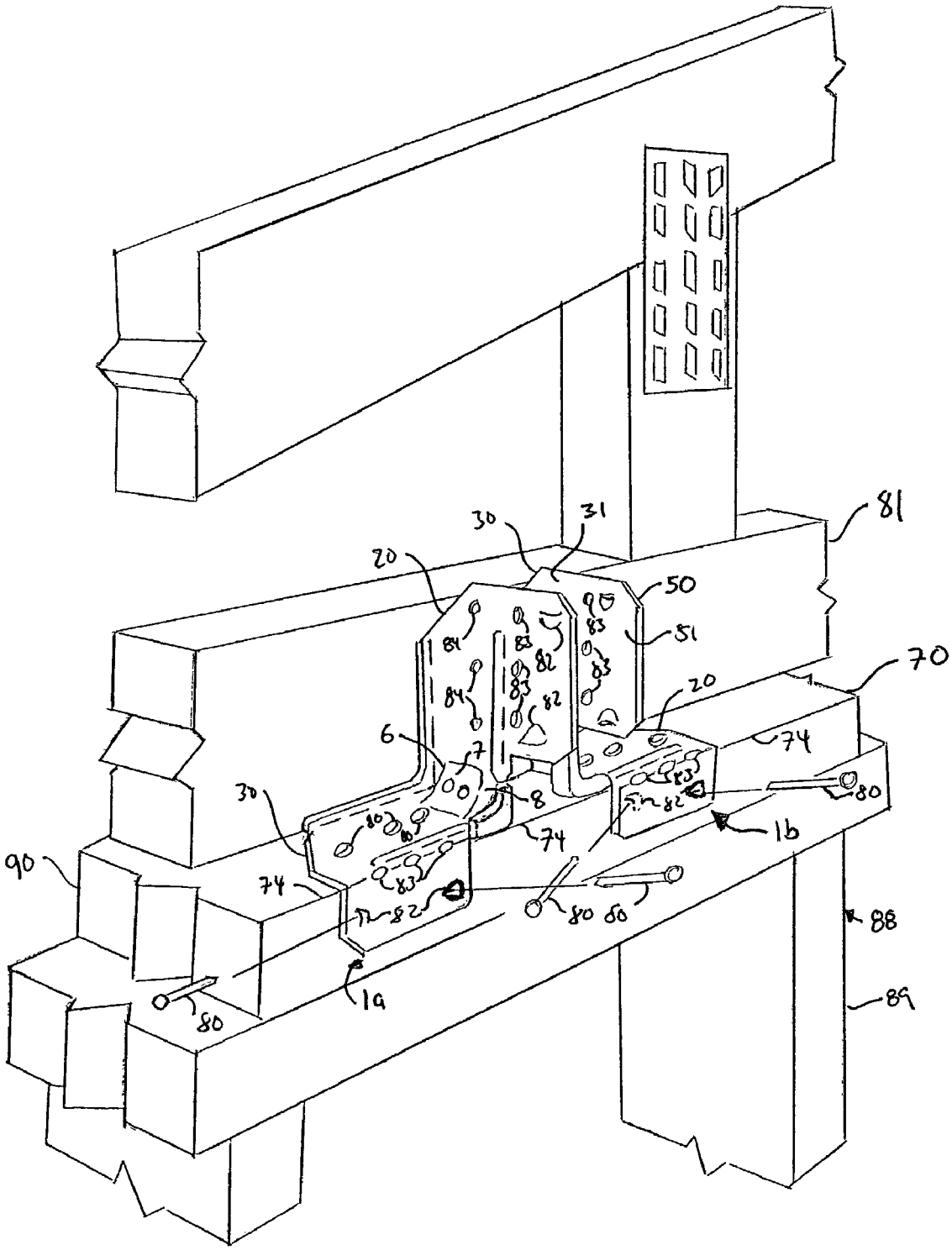
FIG. 2 is a perspective view of the same pair of connectors formed according to the present invention, showing additional nails attaching the connector to the top plate of the wall. The nails are shown entering into the top plate of the wall at an angle due to the use of domed nailing guides as entry points through the connector for the fasteners.

As is shown in FIG. 2, the second extension member 50 of the first connector 1*a* is then bent over such that the outer surface 51 of the second extension member 50 interfaces with the lateral surface 73 of the second structural member 70. The second extension member 50 of the first connector 1*a* is attached to the second structural member 70 by means of fasteners 80.

As shown in the drawing, the fasteners 80 are preferably driven into second structural member 70 at an angle. Fastener guides 82 in the shape of domes are preferably used to help guide the fasteners 80 in at an angle. The two fasteners 80 are driven towards each other into the second structural member 80.

Many different types of fastener guides are known for allowing fasteners 80 that are used with a connector 1 to be driven into the second) structural member 70 at an angle. The following United States Patents teach such guides and all are incorporated herein by reference: U.S. Pat. No. 4,230,416, granted to Tyrell T. Gilb, on Oct. 28, 1980, U.S. Pat. No. 4,291,996, granted to Tyrell T. Gilb, on Sep. 29, 1981, and U.S. Pat. No. 5,603,580, granted to William F. Leek and Alfred D. Commins on Feb. 18, 1997. The domed or half cone-like shaped fasteners guides taught by U.S. Pat. No. 5,603,580 are preferred, and are shown in the drawings.

In the preferred embodiment of the connector 1, where it is made of metal, in order to facilitate the bending of the extension members 40 and 50 with respect to the first and second members 20 and 30, a column of slotted openings 83 is formed at the interface between first and second members 20 and 30 and the first and second extension members 40 and 50. This column of slots 83 weakens the metal, making it easier to bend. It is recommended that the extension members 40 and 50 be bent only once away from the first and second members 20 and 30 to insure all load values are achieved.

As shown in FIG. 2, the slotted openings 83 also help position the connector 1*a* with respect to the lateral edge 74 of the second structural member 70.

Once the first connector 1*a* is attached to the second structural member 70, the second connector 1*b* can be attached to the second structural member 70. The second connector 1*b* can also be attached almost simultaneously with the first connector 1*a*, such that the second member 30 of the first connector 1*a* is attached to the inner surface 71, and then the first member 20 of the second connector 1*b* is attached to the inner surface 71, and so on.

In attaching the second connector 1*b* to the second structural member 70, first, the connector 1*b* is positioned with the first member 20 of the connector 1*b* on the inner surface 71 so that the first structural member 60, in this case a gable brace 60, can be positioned between the connectors 1*a* and 1*b*, and fasteners 80 are driven through the first member 20 and into the inner surface 71 of the second structural member 70 such that said outer surface 21 of the first member 20 of the second connector 1*b* interfaces with the inner surface 71 of the second structural member 70. The fasteners 80, preferably nails, are driven through nail openings 84 in the first member 20 and into the second structural member 70.

Then, the first extension member 40 of the second connector 1*b* is bent over such that the outer surface 41 of the first-extension member 40 interfaces with the lateral surface 73 of the second structural member 70, and fasteners 80 are driven through the first extension member 40 and into lateral surface 73 of the second structural member 70.

As is shown in FIG. 2, the fasteners 80 are preferably driven into second structural member 70 at an angle. Again, fastener guides 82 in the shape of domes are preferably used to help guide the fasteners 80 in at an angle.

Once the first and second connectors 1*a* and 1*b* have been attached to the second structural member 70 at the proper spacing to receive the first structural member 60, in this case a gable brace 60, here a 2×4 member, the gable brace 60 is set between the connectors 1*a* and 1*b* to rest against the inner surface 71 of the second structural member 70 and the gable end truss 81. The first inner face 61 of the gable brace 60 interfaces with the outer surface 21 of the first member 20 of the first connector 1, and the second inner surface 62 of the gable brace 60 interfaces with the outer surface 31 of the second member 30 of the second connector 1*b*.

As is shown in FIG. 3, the first connector 1*a* is then attached to the first structural member 60—in this case the gable brace 60—by means of fasteners 80 such that the outer surface 21 of the first member 20 interfaces with the first of said parallel inner surfaces 61 of the first structural member 60 and the fasteners 80 connect the first member to the first structural member 60.

The second connector 1*b* is also attached to the first structural member 60 by means of fasteners 80 such that the outer surface 31 of the second member 30 of the second connector 1*b* interfaces with the second of the parallel inner surfaces 62 of the first structural member 60 and the fasteners 80 connect the second member 30 to the first structural member 60.

As is shown in FIG. 3, preferably, the first and second parallel inner surfaces 61 and 62 of the gable brace or first structural member 60 interface with the outer surface 41 of the first extension member 40 of the first connector 1*a* and the outer surface 51 of the second extension member 50 of the second connector 1*b*, respectively.

Thus, preferably, fasteners 80 attach the first extension member 40 of the first connector 1*a* to the first inner surface 61 of the first structural member 60, and fasteners 80 attach the second extension member 50 of the second connector 1*b* to the second inner parallel surface 62 of the first structural member 60.

The connector 1 of the present invention is preferably formed from a sheet metal blank of 16 gauge steel, and is formed on progressive die machines that cut and form the connector 1 from a roll of sheet steel.

The connector is bent along a longitudinal line of juncture 2, into which a gusset 6 with a rectangular planar section 7 and two triangular planar sections 8 is embossed. The gusset 6 provides the connector with rigidity and helps it to keep from deforming when loaded.

As shown in FIG. 1, when the connector is formed from sheet metal, the connector is preferably formed with upturned side flanges 10 and 11 at the edges of the first and second members 20 and 30. On the side of the connector 1, where the first and second extensions 40 and 50 connector the side members 20 and 30, the upturned side flange 10 is fairly short. On the side of the connector opposite from the first and second extensions 40 and 50, the upturned side flange 11 is comparatively long. The upturned side flanges 10 and 11 are present at the juncture line 2 traveling through the bend between the first and second members 20 and 30. The upturned side flanges 10 and 11 provide additional strength to the connector 1.

In the preferred form, the connector 1 has a plurality of fastener openings 84 in the first member 20 and a plurality of fastener openings 84 in the second member 30, in order to resist rotational displacement of the first and second structural members 60 and 70 in the planes of the first and second members 20 and 30.

As shown in FIGS. 1-4, when two connectors 1*a* and 1*b* formed according to the present invention are used to anchor the first structural member 60, in this case a wooden gable brace 60, to the second structural member 70, in this case a wooden doubled top plate 70 of an exterior wall, the preferred fasteners 80 are nails. Other fasteners may be used as appropriate, depending on the material of the first and second structural members 60 and 70, such as wood screws, pegs, pins, dowels, adhesives, and welds.

In the preferred embodiment, the size of the nails depend on the sizes of the lumber and the connection that is to be made. For a 2×4 first structural member 70, in this case a gable brace 60 being connected to a doubled 2×4 second structural member 70, in this case a top plate 70, it is preferable to drive 7 8-penny (8*d*) nails per connector into the top plate, and to drive 5 8-penny (8*d*), 1½" long, nails into the gable brace 60 per connector.

In the preferred embodiment, with respect to connector 1*a* shown in FIGS. 1 through 4, three nails 80 are driven through second member 30 at a right angle to the inner surface 71 of the second structural member 70 through fastener openings 84. Two nails 80 are driven through the rectangular planar section 7 of the gusset 6 at an angle to the inner surface 71 of the second structural member 70 through fastener openings 84. Two more nails 80 are driven through the fastener guides 82 in the second extension 50 at an angle to the lateral surface 73 of the second structural member 70.

Then three nails 80 are driven through the first member 20 at a right angle to the first inner surface 61 of the first structural member 60 through openings 84. Then two nails 80 are driven through fastener guides 82 in the first extension 40 at an angle to the first parallel inner surface 61 of the first structural member 61.

The number and angles at which the fasteners 80 are driven through the second connector 1*b* and into the first and second structural members 60 and 70 are similar and not repeated.

Figure 4:
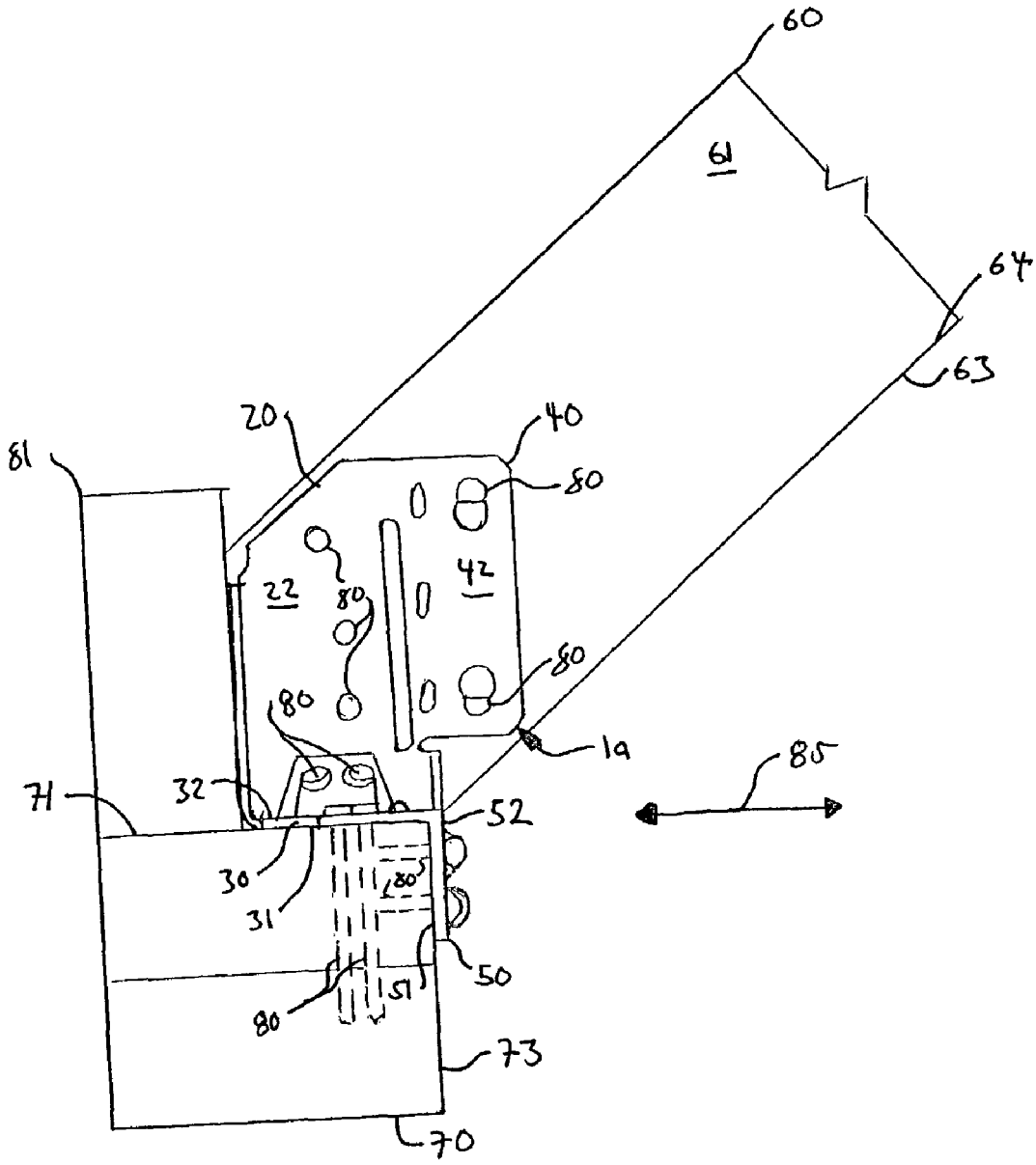
FIG. 4 is a side view of the connection shown in FIGS. 1, 2 and 3. The nails in the top plate are shown as dotted lines.

The inventors have tested the gable brace connection shown in FIGS. 1 through 4 and described above and have found that when using 8-penny (8*d*) fasteners, the connection is effective at resisting forces perpendicular to the second structural member 70, in this case the double top plate 70 of an end wall, see arrow 85 in FIG. 4. When the connection is made from wooden members made from Southern Pine lumber, and the gable brace is set at angle between 40 and 45 degrees from the top surface/inner surface 71 of the top plate/second structural member 70, the allowable load for forces away from the connectors is 635 pounds and for forces towards the connectors is 425 pounds. When the gable brace is set at an angle between 46 and 60 degrees the allowable load for forces away from the connectors is 570 pounds and for forces towards the connectors is 325 pounds.

The nail openings 84 in the first and second members 20 and 30 and) the fastener guides 82 in the first and second extensions 40 and 50 are placed so that when a pair of connectors 1*a* and 1*b* are used to connect a 2×4 first structural member 60, in this case a gable brace 60 as shown in FIG. 3, the nails 80 entering the gable brace through the first member 20 and first extension 30 of the first connector 1*a* are spaced away from the nails 80 entering the gable brace 60 from the second member 30 and second extension 50 of the second connector 1*b* so as to avoid wood splitting.

In the preferred embodiment, for anchoring a 2×4 wooden first structural member 60, in this case a gable brace 60, the length of the first and second members 20 and 30 from the juncture line 2 is typically 3 11/16". The first and second members 20 and 30 are approximately 1⅞" wide, and the first and second extensions 40 and 50 are approximately 1⅛" wide. These dimensions allow the connector 1 to be used to brace a gable brace 60 on a 2×4 second structural member 70, in this case a top plate 70, without interfering with a 2×4 gable end truss 81 sitting at the edge of the top plate.

In the preferred embodiment, as is shown in FIG. 5, the first and second members are of similar dimensions and shape. Similarly, the first and second extensions are of similar dimension and shape. Thus to avoid wood splitting, the nail openings 84 of the first and second members 20 and the fastener guides 82 of the first and second extensions 40 and 50 are not located at the same locations on the first and second members 20 and 30 or the first and second extensions 40 and 50.

Excluding the two nail openings 84 through the rectangular portion 7 of the gusset 6, the three nail openings 84 in the first member 20 are offset from the three nail openings 84 in the second member 30, and similarly, the two nail guides 82 in the first extension 40 are offset from the two nail guides 82 in the second extension 50.

Figure 6:
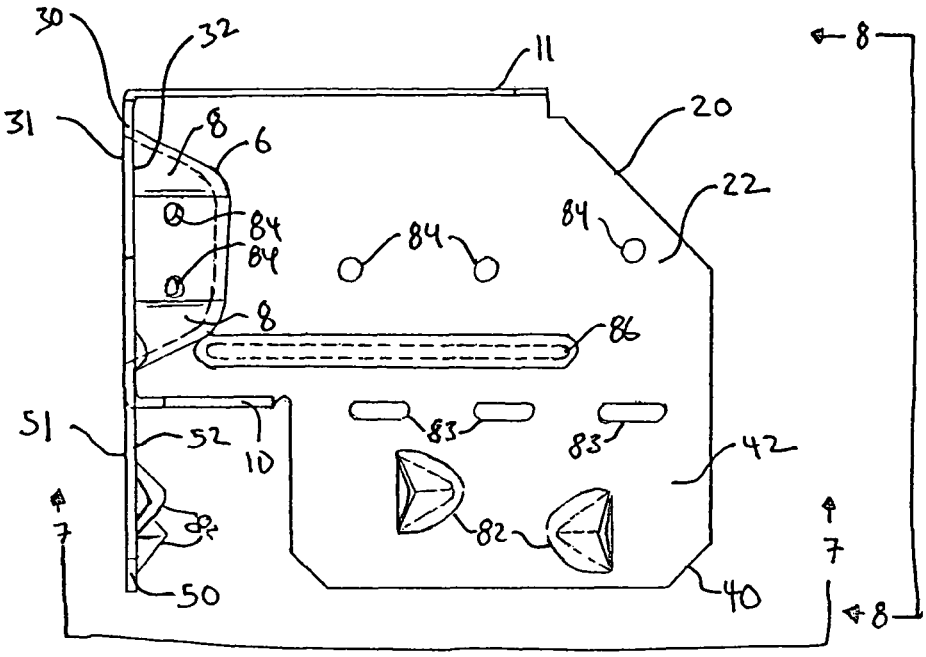
FIG. 6 is a top plan view of the connector of FIG. 5.
Figure 7:
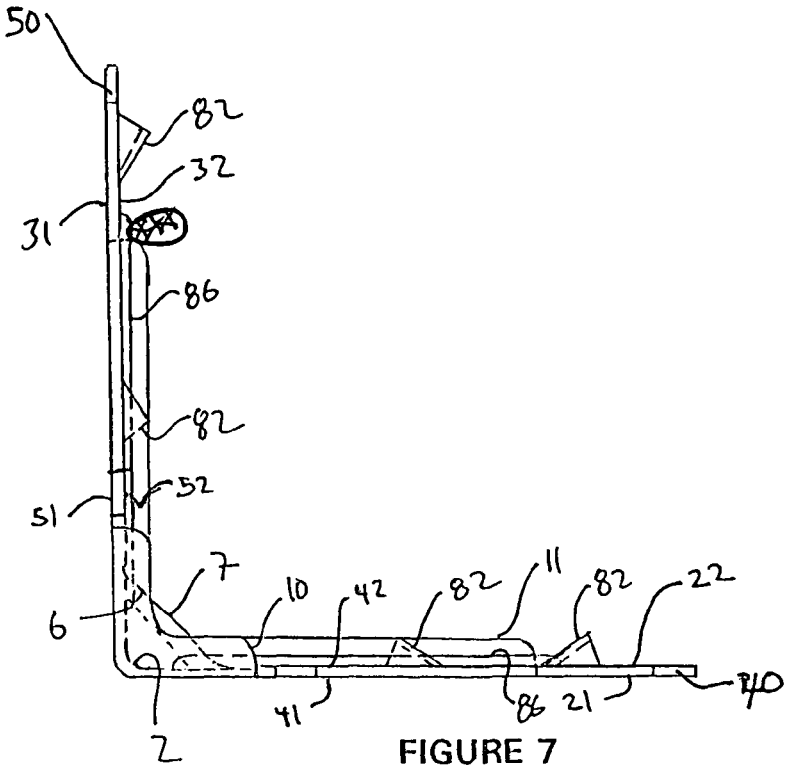
FIG. 7 is a front view of the connector of FIG. 6 taken along line 7—7 of FIG. 6.
Figure 8:
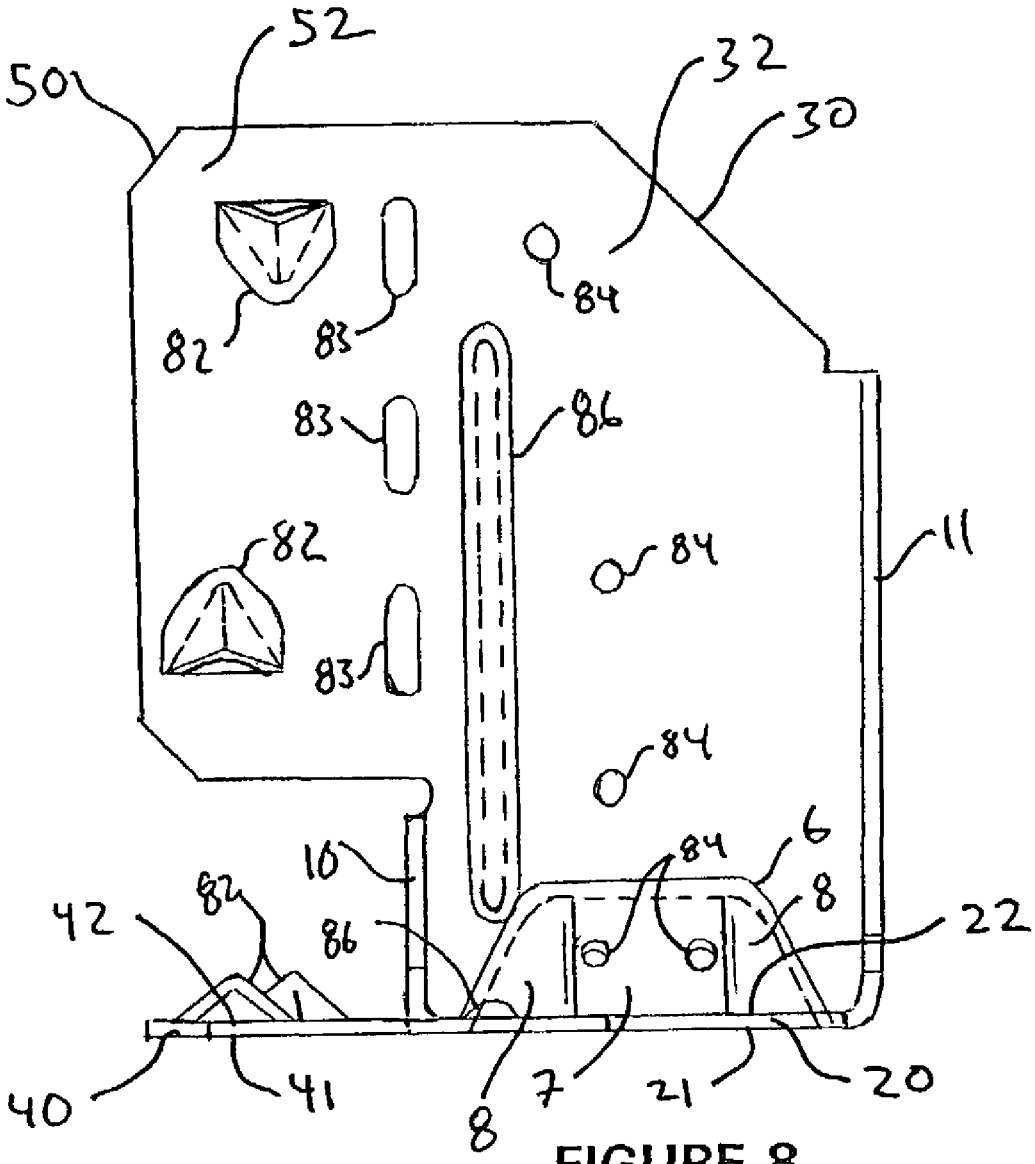
FIG. 8 is a side view of the connector of FIG. 6 taken along line 8—8 of FIG. 6.
Figure 9:
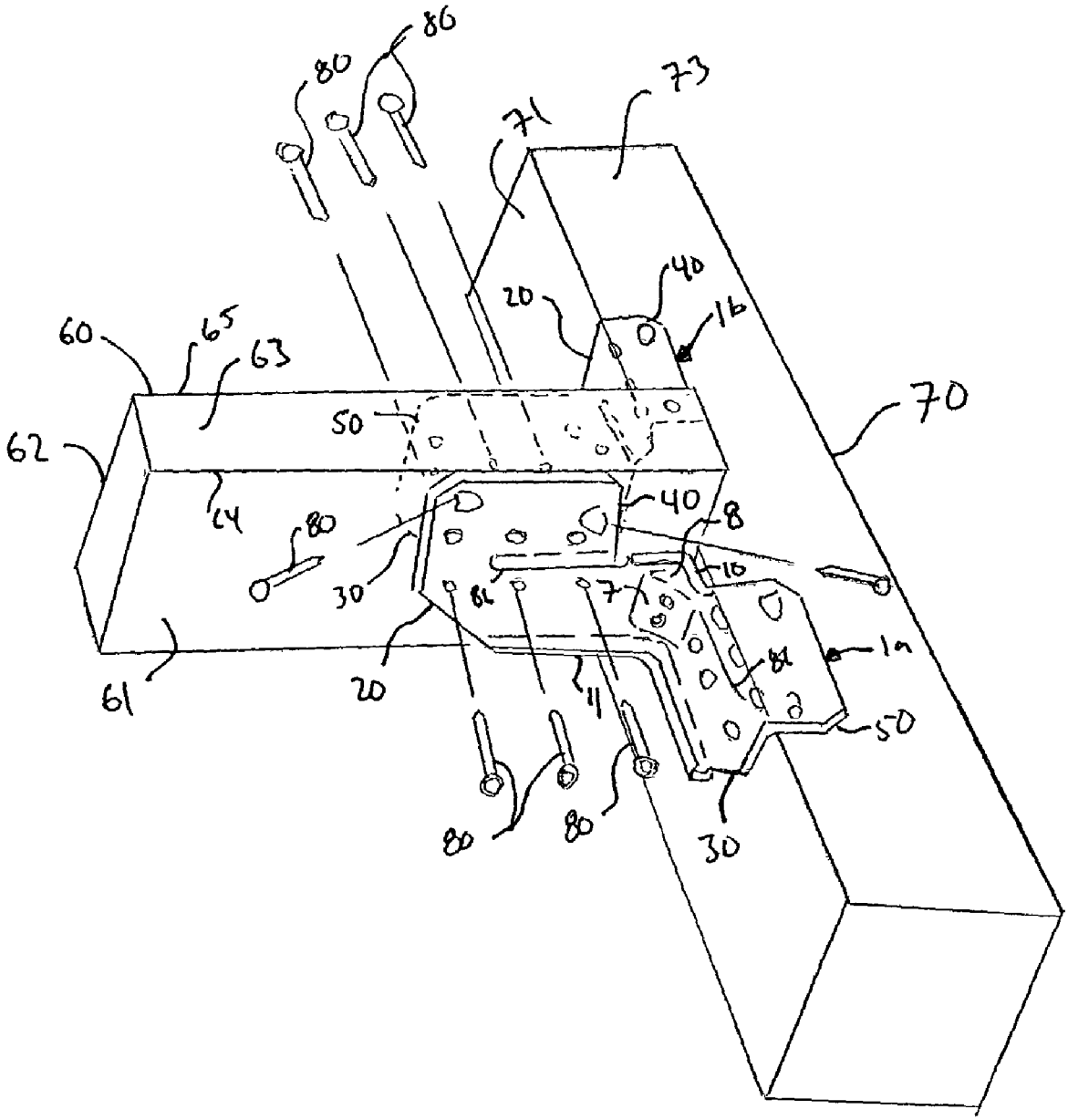
FIG. 9 is a perspective view of a pair of connectors formed according to the present invention connecting a joist to a header. Fasteners are shown, entering into the joist.
Figure 10:
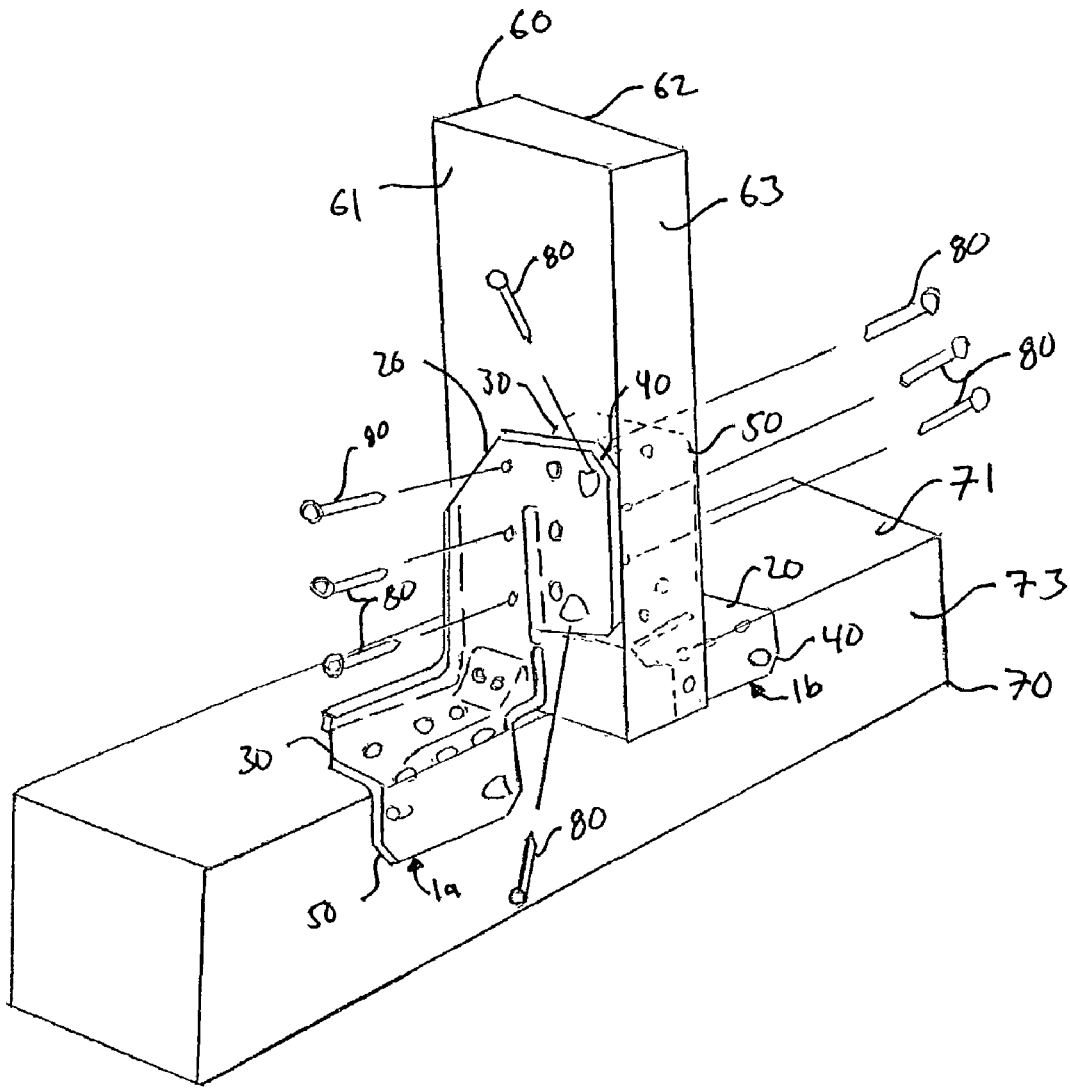
FIG. 10 is a perspective view of a pair of connectors formed according to the present invention connecting a first structural member, in this case a post, to a second structural member, in this case a sill. Fasteners are shown, entering into the post.

As shown in FIGS. 6 and 8, in the preferred embodiment of the connector 1 made from sheet metal, the first and second members 20 and 30 are preferably strengthened by embossments 86 stamped in the metal that run parallel to the interface between the first member 20 and the first extension 40 and the second member 30 and the second extension 50. The embossments 86 are preferably positioned between the nail openings 84 in the first and second members 20 and 30 and the slotted openings 83 at the interface between the first and second members 20 and 30 and the first and second extensions 40 and 50.

All of the descriptions of the use of the present invention have shown and taught a connection between the first and second structural members 60 and 70 with the first structural member 60 terminating and abutting against the second structural member 70; however, it is within the contemplation of the inventors that the second structural member 70 could in fact be two separate structural members, and the structural members need not be in abutting relationship.

The descriptions of the present invention have also described a connector 1 where the first and second members 20 and 30 are set at a right angle to each other, and the first and second structural members 60 and 70 are typical of most wood framing and have a rectangular cross sections, thus the first and second structural members 60 and 70 meet at a right angle and abut each other; however, the connector 1 of the present invention could be used in installations where a right angle connection is not being made, and could be used with structural members that do not have a rectangular cross section.

I claim:

1. A method of forming a connection comprising:

a. selecting a pair of connectors, each of said connectors having 1. first and second members joined together, 2. said first and second members each having an outer surface which can interface with at least a portion of the planar surface of a structural member, said outer surfaces of said first and second members lying at a selected angle to each other, 3. a first extension member joined to said first member, said first extension member having an outer surface that can interface with at least a portion of the same planar surface of a structural member as said outer surface of said first member, and 4. a second extension member joined to said second member, said second extension member having an outer surface that can interface with at least a portion of the same planar surface of a structural member as said outer surface of said second member;

b. selecting a first structural member, said first structural member having a pair of inner surfaces that are substantially planar and lie parallel to each other and a lateral surface that is substantially planar and joins with said inner surfaces along separate edges;

c. selecting a second structural member, said second structural member having an inner surface that is substantially planar and a lateral surface that is substantially planar and joins with said inner surface along an edge;

d. attaching a first of said pair of connectors to said second structural member by means of fasteners such that said outer surface of said second member interfaces with the inner surface of said second structural member and said fasteners connect said second member to said second structural member;

e. attaching said first connector to said first structural member by means of fasteners such that said outer surface of said first member interfaces with the first of said parallel inner surfaces of said first structural member and said fasteners connect said first member to said first structural member;

f. bending said second extension member of said first connector over such that said outer surface of said second extension member interfaces with said lateral surface of said second structural member;

g. attaching said second extension member of said first connector to said second structural member by means of fasteners;

h. attaching a second of said pair of connectors to said second structural member by means of fasteners such that said outer surface of said first member of said second connector interfaces with the inner surface of said second structural member and said fasteners connect said first member to said second structural member;

i. attaching said second connector to said first structural member by means of fasteners such that said outer surface of said second member of said second connector interfaces with the second of said parallel inner surfaces of said first structural member and said fasteners connect said second member to said first structural member;

j. bending said first extension member of said second connector over such that said outer surface of said first extension member interfaces with said lateral surface of said second structural member; and k. attaching said first extension member of said second connector to said second structural member by means of fasteners.

2. The method of claim 1, further comprising:

a. attaching said first extension member of said first connector to said first inner surface of said first structural member by means of fasteners; and b. attaching said second extension member of said second connector to said second inner parallel surface of said first structural member by means of fasteners.

3. The method of claim 1, wherein:

a. said first structural member is a gable brace; and b. said second structural members is a horizontally disposed member of an exterior wall.

4. The method of claim 1, wherein a gable end truss is also attached to the horizontally disposed member at an angle to the gable brace, and the gable brace is not connected to the gable end truss, and the gable end truss does not rest on the first and second connectors, nor does the gable end truss attach to the first and second connectors.

5. The method of claim 1, wherein:

said first and second connectors are formed with a gusset between said first and second members.

6. The method of claim 5, wherein:

said gusset is formed with a rectangular planar section disposed between two triangular planar sections.

7. The method of claim 6, wherein:

said connectors are also formed with side flanges connected to the edges of said first and second members.

8. The method of claim 1, further comprising:

a. bending said first extension member of said first connector over such that said outer surface of said first extension member interfaces with said lateral surface of said first structural member;

b. attaching said first extension member of said first connector to said first structural member by means of fasteners;

c. bending said second extension member of said second connector over such that said outer surface of said second extension member interfaces with said lateral surface of said first structural member; and d. attaching said second extension member of said second connector to said first structural member by means of fasteners.

9. The method of claim 2 wherein:

a. said first structural member is a post; and b. said second structural member is a mudsill.

10. The method of claim 2 wherein:

a. said first structural member is a gable brace; and b. said second structural member is top plate.

11. The method of claim 3 wherein:

a. said second structural member is a top plate.

12. The method of claim 11 wherein:

a. said top plate is a double top plate.

13. The method of claim 12 wherein:

a. said double top plate is made of wood.

14. The method of claim 4 wherein:

a. said first structural member is a gable brace; and b. said second structural member is top plate.

15. The method of claim 7, further comprising:

a. attaching said first extension member of said first connector to said first inner surface of said first structural member by means of fasteners; and b. attaching said second extension member of said second connector to said second inner parallel surface of said first structural member by means of fasteners.

16. The method of claim 15 wherein:

a. said first structural member is a post; and b. said second structural member is a mudsill.

17. The method of claim 15 wherein:

a. said first structural member is a gable brace; and b. said second structural member is top plate.

* * * * *